United States Patent [19]

Palara et al.

[11] Patent Number: 4,563,632

[45] Date of Patent: Jan. 7, 1986

[54] MONOLITHICALLY INTEGRATABLE CONSTANT-CURRENT GENERATING CIRCUIT WITH LOW SUPPLY VOLTAGE

[75] Inventors: Sergio Palara, Bareggio; Bruno Murari, Monza, both of Italy

[73] Assignee: SGS-ATES Componenti Elettronici SpA, Milan, Italy

[21] Appl. No.: 534,146

[22] Filed: Sep. 21, 1983

[30] Foreign Application Priority Data

Sep. 30, 1982 [IT] Italy ..... 23522 A/82

[51] Int. Cl.[4] ..... G05F 3/20

[52] U.S. Cl. ..... 323/316; 323/312

[58] Field of Search ..... 323/312, 315, 316; 307/296 R, 297

[56] References Cited

U.S. PATENT DOCUMENTS 3,536,986 10/1970 Perlman ..... 323/312

4,260,945 4/1981 Ahmad ..... 307/297

OTHER PUBLICATIONS

Th. J. van Kessel et al., Philips Technical Review, vol. 32, 1971, No. 1, "Integrated Linear Basic Circuits", pp. 1–12.

*Primary Examiner*—Peter S. Wong

*Assistant Examiner*—Judson H. Jones

*Attorney, Agent, or Firm*—Wenderoth, Lind & Ponack

[57] ABSTRACT

A monolithically integratable constant-current generating circuit includes a current-generating circuit having a control terminal and two output terminals, from which currents flow that are bound by a constant proportionality ratio.

There is connected to one output terminal the input branch of a circuit having a current mirror and having a current gain which varies with the level of the current itself. A first input terminal of a current-comparator and amplifier circuit is connected to the output branch of the current mirror; a second input terminal is connected to the second output terminal of the current-generating circuit and the control terminal is connected to the output terminal of the current-comparator and amplifier circuit.

12 Claims, 1 Drawing Figure

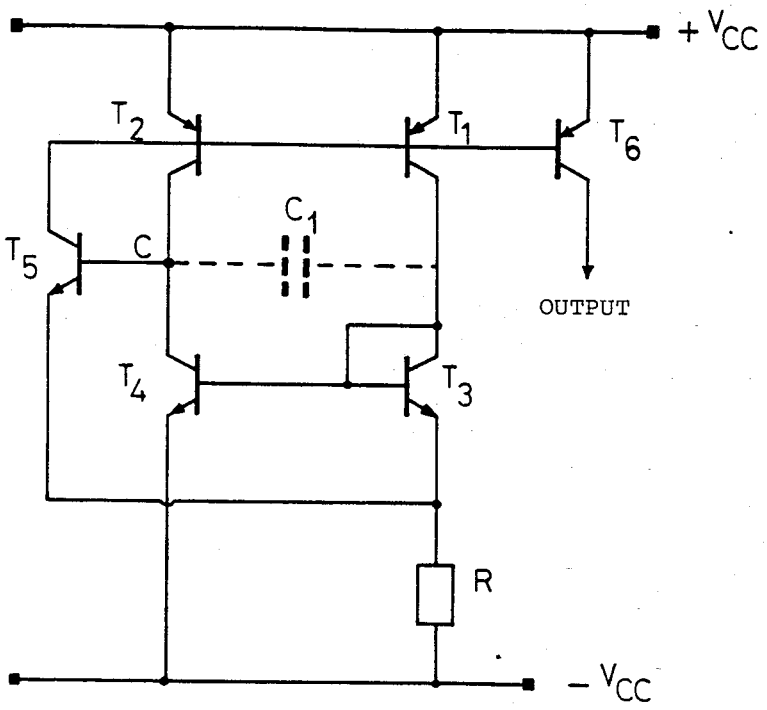
+ $V_{CC}$
$T_2$
$T_1$
$T_6$
$C_1$
$T_5$
C
OUTPUT
$T_4$
$T_3$
R
− $V_{CC}$

MONOLITHICALLY INTEGRATABLE CONSTANT-CURRENT GENERATING CIRCUIT WITH LOW SUPPLY VOLTAGE

BACKGROUND OF THE INVENTION

The present invention relates to constant-current generating circuits and, more particularly, to a constant-current generating circuit which is independent of the supply voltage and is adapted for use in linear integrated circuits with a low supply voltage.

As is well known, a constant current source can be produced simply by applying a constant voltage to a sufficiently high resistance.

In integrated circuits where one tends to minimize the values of the resistances, the constant-current generators are produced with circuits which comprise, apart from one or more limited-value resistances, active elements such as transistors.

This type of constant-current generating circuit known in the prior art uses a first NPN transistor which is inserted between the two poles of a supply voltage generator in a common emitter configuration.

The transistor base is connected to the positive pole through a resistor and to the negative pole by means of a Zener diode which limits the base potential with respect to the negative pole. The transistor emitter is connected to the negative pole through a suitable emitter resistor, and the collector is connected to the positive pole by means of a diode which, with a second transistor included in the circuit, constitutes a current mirror in whose output branch the collector current of the first transistor is mirrored.

Since the Zener diode limits the base potential of the first transistor and since the base-emitter voltage thereof can be considered constant, a constant voltage is applied to the emitter resistor which produces a constant emitter current and, thus, a constant collector current.

The constant collector current is mirrored in the output branch of the current mirror to which a user circuit can be connected.

Since the internal resistance of the Zener diode is very small, i.e.—negligible, compared to the resistance through which the base of the first transistor is connected to the positive pole of the supply voltage generator, variations of the supply voltage, if any, will not cause appreciable variations in the voltage between the base of the first transistor and the negative pole thanks to the voltage divider formed by the resistor and the Zener diode. Therefore, in a first approximation, the collector current of the first transistor can be considered constant and independent of the supply voltage.

In reality, since the voltage across the emitter resistor is constant, the variations of the supply voltage cause corresponding variations of the collector-emitter voltage of the first transistor and, hence, variations of the collector current as a result of the Early effect.

Therefore, the circuit described above can be used as a constant-current generator only if the supply voltage is only subject to small variations.

A well-known technique which enables one to obtain a constant-current generator that can be integrated monolithically without the use of constant-voltage reference points consists in appropriately coupling two circuits that have a current-mirror structure.

A constant-current generating circuit thus obtained, as known to those skilled in the art, comprises a first current-mirror circuit which includes first and second NPN transistors whose bases are tied together and have emitters that have different emitter areas.

One of the transistors has its base and collector connected as a diode and one resistor is connected to the emitter of the transistor having a larger emitter area; such a resistor and the ratio between the emitter areas of the two transistors are designed such that currents of equal magnitude flow in the collectors of the two transistors.

The circuit comprises a second current-mirror circuit formed by two PNP transistors, one of which has its base and collector connected as a diode, the bases of both transistors being tied together and their emitters having equal areas.

The circuit also comprises one or more output transistors which are suitably coupled, for example, according to a current-mirror structure, to the first or second current-mirror circuit included therein.

The first and second current mirrors, which are inserted between the two poles of a supply voltage generator, can have the collectors of the two PNP transistors directly connected to the collectors of the two NPN transistors according to a simple-ring structure, or coupled by means of cascaded transistors according to more complex structures known in the prior art so as to obtain a higher degree of precision and stability, although it requires a higher minimum supply voltage due to the greater voltage losses.

The prior art described above and a constant-current generating circuit obtained thereby are indicated in an article by Th. J. van Kessel and R. J. van de Plassche entitled "Integrated linear basic circuits" published in "Philips Technical Review" (volume 32, 1971, No. 1, pp. 1–12 with particular reference to FIG. 10 at page 7).

However, it should be noted that even this type of current-generating circuit, due to the Early effect, supplies a constant current which is independent of the supply voltage only within a limited range of possible variations thereof, although much broader than that allowed for the circuit in relation to the supply voltage described previously.

SUMMARY OF THE INVENTION

The object of the present invention is to provide a simple and low-cost circuit for a low supply voltage that can be integrated monolithically, and which generates a constant current, and which is really independent of the supply voltage.

This object is achieved with the constant-current generating circuit as defined and characterized in the claims at the end of this description.

BRIEF DESCRIPTION OF THE DRAWING

The invention will be better understood with the aid of the ensuing detailed description given solely by way of non-limitative example, with reference to the accompanying drawing in which the one and only FIGURE is the diagram of a constant-current generating circuit embodying the teachings of the invention.

DESCRIPTION OF THE PREFERRED EMBODIMENT

The diagram of the constant-current generating circuit according to the invention shown in the drawing comprises first and second bipolar PNP transistors $T_1$ and $T_2$, whose bases are tied together and whose emitters are connected to the positive pole $+V_{cc}$ of a supply voltage generator.

The circuit also includes third ($T_3$), fourth ($T_4$), and fifth ($T_5$) bipolar transistors of the NPN type. The collector of $T_3$ is connected to the collector of $T_1$; the collector of $T_2$, the collector of $T_4$, and the base of $T_5$ are tied together in a circuit node C.

The base of $T_3$ is connected to its collector and to the base of $T_4$.

The emitters of $T_3$ and $T_5$ are connected to the negative pole $-V_{cc}$ of the supply-voltage generator through the same resistor R; the emitter of $T_4$ is also connected to $-V_{cc}$.

The collector of $T_5$ is connected to the bases of $T_2$ and $T_1$, to which is also connected the base of a sixth bipolar PNP transistor $T_6$ whose emitter is connected to $+V_{cc}$ and whose collector forms the output terminal of the circuit. Also connected to the bases of $T_1$ and $T_2$ is the output terminal of a firing circuit (not shown in the FIGURE) which serves to supply the initial minimum current for the operation of the circuit and which is quickly turned off. In the FIGURE there is indicated with a broken line a capacitor $C_1$ which can also be inserted between the node C and the connecting point of the collectors of $T_1$ and $T_3$ in order to improve the stability characteristics of the circuit.

Let us now examine in particular the operation of the circuit whose diagram is shown in the FIGURE.

The bases of the transistors $T_1$ and $T_2$ are tied together, so the values of the collector currents of said transistors are bound by a constant proportionality ratio.

The transistor $T_3$, connected as a diode, and $T_4$ form a current-mirror circuit which, due to the resistance R through which the collector current of the transistor $T_5$ also flows, has a current gain which varies non-linearly with the magnitude of the current. The input branch is the connection between the base and the collector of $T_3$ in which flows a current from the collector of $T_1$ which is mirrored in the output branch formed by the collector of $T_5$.

In the node C, the collector current of $T_4$, which is a function of the collector current of $T_1$, is "confronted" with the reference current flowing from the collector of $T_2$ and the "error" or "difference" current, is amplified by the transistor $T_5$ and used to control $T_1$ and $T_2$, regulating in this way the collector currents of $T_1$ and $T_2$.

By suitably designing the circuit, the automatic regulation of the collector current of $T_1$, which is mirrored at the output, can be regulated to a prespecified constant value.

The design of the circuit of the invention shown in the FIGURE is very simple and particularly if the circuit is integrated monolithically, such a simplicity enables one to easily obtain a high degree of operating precision.

Let is be assumed that the circuit is in normal and stable operating conditions such as to produce a constant collector current $I_1$ in the transistor $T_1$:

$$I_1 = \text{const} = KI_2$$

wherein $I_2$ stands for the collector current of $T_2$, and K for the proportionality constant between the two currents.

Since the transistors $T_1$ and $T_2$ are controlled by the transistor $T_5$ which regulates the conduction thereof, the base current $I_{B5}$ of $T_5$ must have a value which is equal to:

$$I_{B5} = \frac{I_5}{\beta_5} = \frac{I_1}{\beta_5 \cdot \beta_1} + \frac{I_2}{\beta_5 \cdot \beta_2} = I_2\left(\frac{K}{\beta_5 \cdot \beta_1} + \frac{1}{\beta_5 \cdot \beta_2}\right)$$

where $I_5$ is the collector current of $T_5$, and $\beta_1$, $\beta_2$, and $\beta_5$ are the current gains of $T_1$, $T_2$, and $T_5$, respectively.

The base current of $T_5$ whose value must be the value first calculated in order to be able to regulate the collector current of $T_1$ to the value of $I_1$ is, as mentioned above, the "error" current resulting from the confrontation between the collector current $I_2$ of $T_2$ which is proportional to $I_1$, and the collector current $I_4$ of $T_4$, as a function of the collector current $I_3$ of $T_3$. Thus, the following two conditions must be satisfied simultaneously:

$$I_4 = I_2 - I_{B5} = I_2\left(1 - \frac{K}{\beta_5 \cdot \beta_1} - \frac{1}{\beta_5 \cdot \beta_2}\right) \quad (1)$$

$$I_4 = \beta_4\left(I_1 - I_3 - \frac{I_3}{\beta_3}\right) = \beta_4\left(KI_2 - I_3 - \frac{I_3}{\beta_3}\right) \quad (2)$$

where $\beta_3$ and $\beta_4$ are the current gains of $T_3$ and $T_4$, respectively.

From the equation (2) one obtain the relationship:

$$I_2 = \frac{I_4}{K\beta_4} + \frac{I_3}{K} + \frac{I_3}{K\beta_3}$$

which, substituted in (1) gives:

$$I_4 = \left(\frac{I_3}{K} + \frac{I_3}{K\beta_3} + \frac{I_4}{K\beta_4}\right)\left(1 - \frac{K}{\beta_5 \cdot \beta_1} - \frac{1}{\beta_5 \cdot \beta_2}\right)$$

For a sufficiently high current gain of transistors $T_1$, $T_2$, $T_3$ and $T_4$ and for values of K that are not too high, the last terms within each parenthetical expression are negligible, so the only condition for the dimensioning of the circuit in stable operating conditions and constant currents is:

$$I_3 = KI_4, \quad (3)$$

regardless of the supply voltage and regardless of the current gain of the transistor $T_5$, if the latter is at least equal to 1 to close thereto.

Since the collector current of $T_1$ depends on the ratio between the emitter areas of $T_3$ and $T_4$ and the value of the resistance R, it is always possible to preset $I_1$ and at the same time satisfy the condition (3), or the condition:

$$\frac{I_1}{I_2} = \frac{I_3}{I_4}$$

The dimensioning of the circuit is very simple in the case where the emitter areas of $T_1$ and $T_2$ are equal and, hence, $I_1 = I_2$. In fact, since the voltage drop $V_R$ across the resistor R equals the difference between the base-emitter voltages of $$T_4 \text{ and } T_3,\ V_{BET4} - V_{BET3} = \frac{KT}{q} \ln \frac{I_4 A_3}{I_3 A_4},$$

where $I_3 \cong I_4$, the only condition for the dimensioning, is:

$$V_R = \frac{KT}{q} \ln \frac{A_2}{A_1}$$

Let us now assume that in the circuit shown in the FIGURE, appropriately dimensioned for a given value of the current $I_1$, a variation of the same with respect to the preset value (e.g., an increase due to the Early effect due to an increase of the supply voltage) occurs.

The voltage drop across the resistor R increases, so that the base-emitter voltage $V_{BET}$ of $T_4$ also increases; an increment of the current $I_4$ which is absorbed by $T_4$ is then determined, and is higher than the variation of $I_1$, and a resultant decrease of the base current of $T_5$ occurs.

The collector and emitter currents of $T_5$ decrease and, thus, the conduction of both $T_2$ and $T_1$ decrease at the same time as the voltage drop across R, so that the initial stable conditions are restored.

The reverse occurs for a decrease in the value of $I_1$ relative to the preset value and in this case, too, the current $I_1$ is returned to said preset value.

This happens, for example, at the time of firing the circuit when the low initial current, due to the firing circuit—which is suddenly turned off—is quickly brought to the desired level. To avoid harmful oscillations of the system during the control and regulation of the current generated between the node C and the connecting point between the collectors of $T_1$ and $T_3$, a suitable capacitor is usually inserted, as shown by the broken line in the FIGURE, or a more economical resistor may be inserted, even to the detriment of the precision of the regulation. A current-generating circuit according to the invention is particularly adapted for monolithic integration and, in this case, results in economic benefits due to the ease of operation and the limited number of components.

This is also very advantageous because it requires a minimum low supply voltage (approximately 0.8 V) and produces a high degree of operating precision with all the values of supply voltage, its "voltage losses" (or the minimum voltage required, so that the circuit maintains its typical operating characteristics) being equal only to the sum of a base-emitter voltage plus a collector-emitter saturation voltage.

While only one specific embodiment of the invention has been illustrated and described, it is readily apparent that numerous modifications can be made without departing from the scope of the invention.

For example, the emitter of the transistor $T_5$ could be directly connected to the negative pole $-V_{cc}$. Furthermore, the two types of transistors could be interchanged without deleteriously affecting the operation of the circuit.

The output transistor $T_6$ could also be connected to the transistor $T_4$ instead of to the transistor $T_1$.

We claim:

1. A monolithically integratable constant-current generating circuit for use with a low supply voltage and having a first and a second terminal which are connected to first and second poles of a supply voltage generator and having a least one output terminal to which a user circuit can be connected, said constant current circuit comprising:

a current-generating circuit means having a control terminal and a first terminal and a second terminal, the magnitudes of output currents from said first and said second terminals being bound by a constant proportionality ratio;

a current-mirror circuit means having an input branch connected to said first terminal of said current-generating circuit means, and having an output branch, said current-mirror circuit means having a current gain which is variable with respect to its current level, an output terminal of said current-mirror being coupled to at least one of said terminals of said current-generating circuit means; wherein said constant-current generating circuit comprises a current-comparator and amplifier circuit means, having a first input terminal and a second input terminal of said current-generating circuit means and to said output branch of said current-mirror circuit means, and having an output terminal which is connected to said control terminal of said current-generating circuit means;

wherein said current-generating circuit means comprises a first transistor and a second transistor, each having a first type of conductivity and each having a first terminal and a second terminal and a control terminal, said first terminals of said first and second transistors being connected to said first pole of said supply voltage generator, said second terminal of said first transistor and said second terminal of said second transistor respectively comprising said first and second output terminals of said current-generating circuit means, said control terminal of said first transistor being connected to said control terminal of said second transistor said connection of said control terminals forming said control terminal of said current-generating circuit means; wherein said current-mirror circuit means comprises a third transistor and a fourth transistor, each having a second type of conductivity which is opposite to said first type of conductivity and each having a first terminal and a second terminal and a control terminal, said first terminal of said third transistor being connected by means of a resistance to said second pole of said supply voltage generator to which said first terminal of said fourth transistor is also connected, said control terminal of said fourth transistor being connected to said control terminal of said third transistor which is connected to said second terminal of said same third transistor, said connection between said control terminal and said second terminal of said third transistor forming said input branch of said current-mirror circuit means, and said output branch of said current-mirror means is formed by said second terminal of said fourth transistor; and wherein said current-comparator and amplifier circuit means comprises a comparator node connected to said second input terminal of said current-generating circuit means and to said output branch of said current-mirror circuits means, and a fifth transistor having a first terminal coupled to said second pole of said supply voltage generator, and having a second terminal connected to said control terminal of said current-generating circuit means and a control terminal connected to said comparator node.

2. A constant-current generator circuit according to claim 1, wherein said first terminal of said fifth transistor is connected to said second pole of said supply voltage generator through said same resistance through which said pole is connected to said first terminal of said third transistor, and wherein said fifth transistor has a conductivity of said second type.

3. A constant-current generating circuit according to claim 2, further comprising a sixth transistor having a control terminal which is coupled to said control terminal of the first transistor and having a first terminal which is connected to said first pole of said supply voltage generator and having a second terminal which forms said output terminal of said constant-current generating circuit.

4. A constant-current generating circuit according to claim 1, wherein transistors comprise bipolar transistors, said first terminal, control terminal, and second terminal of each being, respectively, an emitter, a base, and a collector.

5. A constant-current generating circuit according to claim 4, wherein said first and second transistors have equal emitter areas, and said third transistor has an emitter area which is larger than an emitter area of said fourth transistor, the ratio between said emitter areas of said third and fourth transistors and the value of said resistance being arranged so as to produce equal current flows in said collectors of said third and fourth transistors.

6. A constant-current generating circuit according to claim 1, further comprising a sixth transistor having a control terminal which is coupled to said control terminal of the first transistor and having a first terminal which is connected to said first pole of said supply voltage generator and having a second terminal which forms said output terminal of said constant-current generating circuit.

7. A constant-current generating circuit according to claim 2, wherein transistors comprise bipolar transistors, said first terminal, control terminal, and second terminal of each being, respectively, an emitter, a base, and a collector.

8. A constant-current generating circuit according to claim 3, wherein transistors comprise bipolar transistors, said first terminal, control terminal, and second terminal of each being, respectively, an emitter, a base, and a collector.

9. A constant-current generating circuit according to claim 6, wherein transistors comprise bipolar transistors, said first terminal, control terminal, and second terminal of each being, respectively, an emitter, a base, and a collector.

10. A constant-current generating circuit according to claim 7, wherein said first and second transistors have equal emitter areas, and said third transistor has an emitter area which is larger than an emitter area of said fourth transistor, the ratio between said emitter areas of said third and fourth transistors and the value of said resistance being arranged so as to produce equal current flows in said collectors of said third and fourth transistors.

11. A constant-current generating circuit according to claim 8, wherein said first and second transistors have equal emitter areas, and said third transistor has an emitter area which is larger than an emitter area of said fourth transistor, the ratio between said emitter areas of said third and fourth transistors and the value of said resistance being arranged so as to produce equal current flows in said collectors of said third and fourth transistors.

12. A constant-current generating circuit according to claim 9, wherein said first and second transistors have equal emitter areas, and said third transistor has an emitter area which is larger than an emitter area of said fourth transistor, the ratio between said emitter areas of said third and fourth transistors and the value of said resistance being arranged so as to produce equal current flows in said collectors of said third and fourth transistors.

* * * * *